US005727582A

United States Patent [19]

Terui

[11] Patent Number: 5,727,582

[45] Date of Patent: Mar. 17, 1998

[54] WORK CARRIER ASSEMBLY

[75] Inventor: Yoshinobu Terui, Ayase, Japan

[73] Assignee: Speedfam Clean System Co., Ltd., Ayase, Japan

[21] Appl. No.: 778,818

[22] Filed: Jan. 3, 1997

[30] Foreign Application Priority Data

May 9, 1996 [JP] Japan ..... 8-139646

[51] Int. Cl.[6] ..... B08B 3/04

[52] U.S. Cl. ..... 134/140; 134/159; 134/902; 211/1.52

[58] Field of Search ..... 134/902, 140, 134/143, 157, 158, 159; 15/77; 211/1.52, 1.53

[56] References Cited

U.S. PATENT DOCUMENTS

| | | | |
|---|---|---|---|
| 3,679,517 | 7/1972 | Schulten et al. | 134/902 |
| 3,760,822 | 9/1973 | Evans | 134/902 |
| 3,964,957 | 6/1976 | Walsh | 134/902 |
| 4,077,416 | 3/1978 | Johnson, Jr. et al. | 134/902 |
| 4,167,320 | 9/1979 | Hutcheinson | 134/159 |
| 4,202,072 | 5/1980 | Scharpf | 134/153 |
| 4,325,394 | 4/1982 | Reams | 134/902 |
| 4,516,523 | 5/1985 | Knox | 134/159 |
| 5,203,360 | 4/1993 | Nguyen et al. | 134/153 |

FOREIGN PATENT DOCUMENTS

| | | | |
|---|---|---|---|
| 62-283632 | 12/1987 | Japan | 134/902 |
| 4-22411 | 5/1992 | Japan . | |

*Primary Examiner*—Frankie L. Stinson

*Attorney, Agent, or Firm*—Oblon, Spivak, McClelland, Maier & Neustadt, P.C.

[57] ABSTRACT

A work carrier assembly 1 having first and second carrier members 2 and 3 which are separably engageable with each other. Each one of the two carrier members 2 and 3 is provided with a plural number of parallel work holder rods 11 or 14 between a pair of side frames 10 or 13. The work holder rods 11 and 14 on the two carrier members are located in vertically staggered position and shifted relative to each other in a forward or rearward direction.

5 Claims, 3 Drawing Sheets

WORK CARRIER ASSEMBLY

BACKGROUND OF THE INVENTION

1. Field of the Art

This invention relates to a work carrier assembly especially suitable for use in transferring articles of substantially flat disc-like shapes such as magnetic recording disc substrates in general including glass substrates and ceramic substrates, and various other electronic, optical or mechanical parts of such shapes.

2. Prior Art

In regard to an apparatus for processing work pieces of flat plate-like shapes like substrates of magnetic recording discs, it has been known in the art to transfer a plural number of such work pieces on a carrier along a predetermined processing line containing washing and drying stages or stages of other treatments which are required in processing the work pieces, for example, from Japanese Utility Model Publication H4-22411.

In a processing apparatus of this sort, work pieces can be processed in an extremely efficient manner by the use of a carrier or carriers which can transfer a plural number of work pieces collectively. However, in prior art processing apparatus of this sort, one and same type of carrier is used through work loading, unloading and transferring stages, despite the necessity for supporting work pieces differently in different stages. For example, when loading and unloading work pieces, it is desirable for a work carrier to support work pieces stably in a non-rotatable state. Nevertheless, a work carrier should be able to support work pieces rotatably while receiving a certain treatment and, if necessary, should be able to support work pieces in different positions in loading and unloading operations from support positions in certain treatments, changing the manner of supporting work pieces depending upon the nature of operation or treatment.

SUMMARY OF THE INVENTION

It is an object of the present invention to provide a work carrier assembly of high versatility, which can load and unload a plural number of work pieces collectively into and out of a work treating apparatus and at the same time can support individual work pieces under treatment in a different manner from a support in loading and unloading operations.

In accordance with the present invention, there is provided a work carrier assembly having first and second work carrier members separably engaged with each other. The two work carrier members are each provided with a plural number of parallel work holder rods for supporting thereon flat plate-like work pieces. The work support rods of the two carriers are located in staggered positions which are shifted relative to each other in a forward or rearward direction in terms of travel direction of the carrier members and also in a vertical direction in such a way that work pieces are supported on one carrier member while the two carriers are engaged with each other and picked onto the other carrier member when the two carriers are separated from each other.

According to one specific form of the invention, the first carrier member is mounted on the work treating apparatus to support the work pieces during a treatment, and the second carrier member cooperates with the first carrier member to load and unload work pieces before and after a treatment. The second carrier member is vertically movable into and out of engagement with the first carrier member.

The work holder rods of the above-described second carrier member are shifted in position to the front or rear side of the carrier assembly and arranged to support work pieces in lower positions than the work holder rods of the first carrier member.

As a consequence, work pieces which are placed on the work holder rods of the second carrier member are automatically transferred onto and supported by the work holder rods of the first carrier as the second carrier member is lowered into engagement with the latter because the work holder rods of the second carrier member are lowered into positions beneath the work holder rods of the first carrier member.

As the second carrier member is removed from the first carrier member after finishing a treatment on the work pieces on the work holder rods of the first carrier member, the respective work pieces are automatically picked up on the work holder rods of the second carrier member and thereby ejected from the treating apparatus.

Thus, the work carrier assembly according to the present invention employs two types of carrier members, using the first carrier member for supporting work pieces while in a processing treatment and using the second carrier member for loading and unloading work pieces on and off the first carrier member. Therefore, the first carrier member can be arranged in a construction particularly suitable for supporting work pieces during a particular treatment, while the second carrier member can be arranged in a construction suitable for loading and unloading work pieces. This it becomes possible not only to transfer a plural number of work pieces collectively by the second carrier member but to support individual work pieces under treatment in a manner which is suitable for a particular treatment or treatments involved.

According to another specific form of the present invention, the work holder rods of the two carrier members are arranged in vertically staggered positions concentrically along outer peripheries of disc-like work pieces in such a manner as to form a pocket for the work pieces.

According to still another specific form of the present invention, the work holder rods on the first carrier member are rotatably provided in the respective positions while the work holder rods on the second carrier member are fixedly provided in the respective positions.

In the work carrier assembly according to the invention, it is desirable to provide hooks on the second carrier member thereby to lift the carrier member up and down relative to the first carrier member.

BRIEF DESCRIPTION OF THE DRAWINGS

The above and other objects, features and advantages of the invention will become apparent from the following description, taken in conjunction with the accompanying drawings which show by way of example a preferred embodiment of the invention and in which.

DESCRIPTION OF PREFERRED EMBODIMENTS

Figure 1:
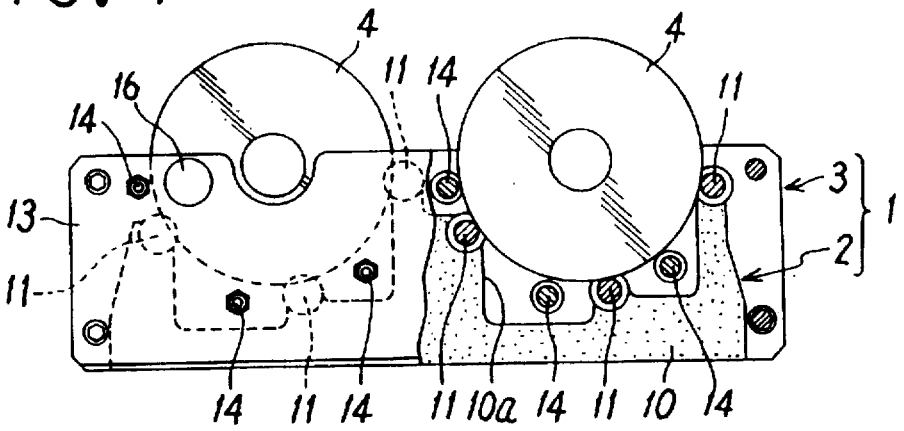
FIG. 1 is a partly cutaway side view of a work carrier assembly embodying the present invention.
Figure 2:
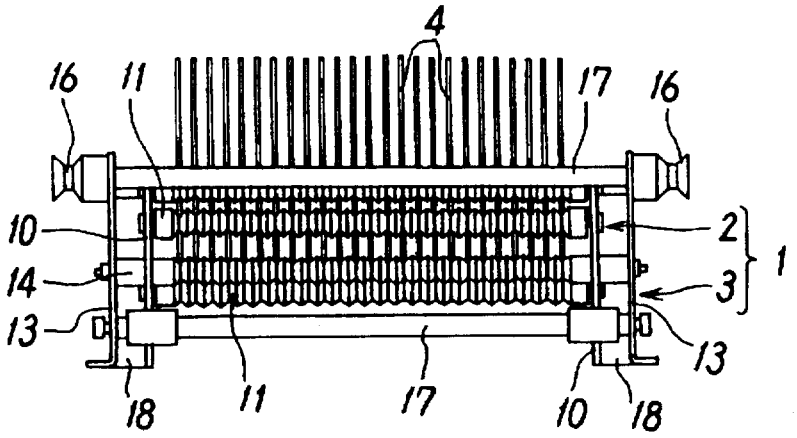
FIG. 2 is a schematic front view of the work carrier assembly of FIG. 1.

Shown in FIGS. 1 and 2 is a preferred embodiment of the work carrier assembly according to the present invention. The work carrier assembly 1 is composed of a first work carrier member 2 and a second carrier member 3 which are separably engaged with each other.

Figure 3:
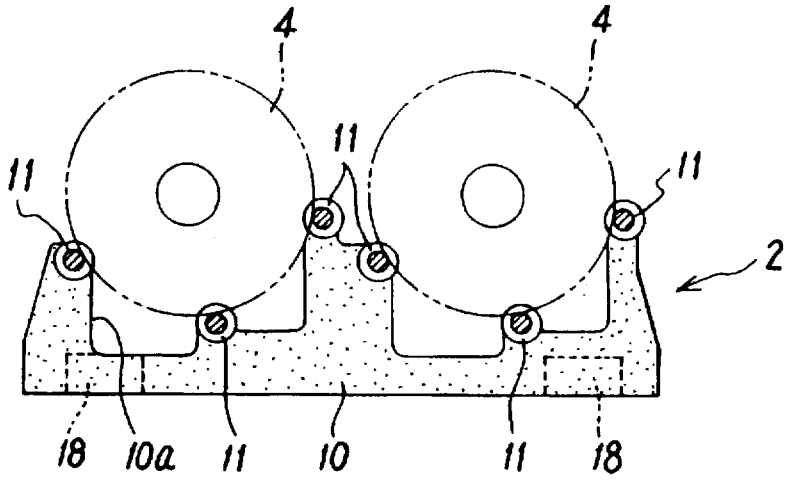
FIG. 3 is a sectioned side view of a work supporting carrier member.
Figure 4:
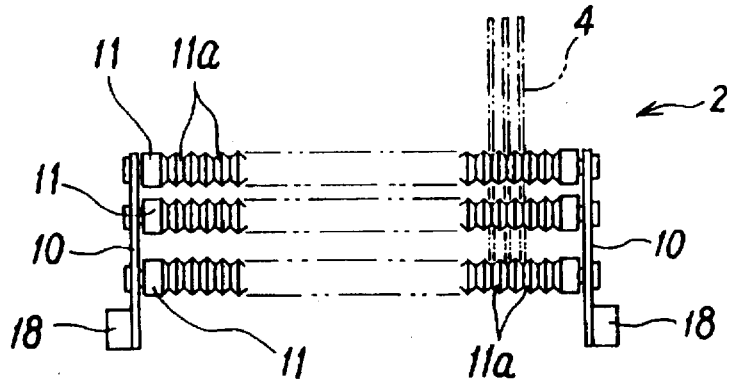
FIG. 4 is a front view of the supporting carrier member of FIG. 3.

The first work carrier member 2 is mounted, for example, on a work transfer table of a work treating apparatus for supporting a number of work pieces, and as shown in FIGS. 3 and 4, it includes a pair of opposingly positioned frames 10, and a plural number of parallel work holder rods 11 (three holder rods being used as one set in the particular embodiment shown) which are rotatably supported between the frames 10 in vertically staggered positions forming a pocket in concentric relation with outer peripheries of individual work pieces 4. Each work holder rod 11 of the carrier member 2 is circumferentially formed with a plural number of grooves 11*a* at predetermined intervals along its length for engagement with circumferential edges of the work pieces 4. Accordingly, the individual work pieces 4 are supported in upright positions at a number of different points along the respective outer peripheries by engagement with the circumferential grooves 11*a* on a set of work holder rods 11.

The first carrier member 2 may be fixed on the work transfer table of the work treating apparatus or other support structure by arbitrary means, for example, by fixing the frames 10 by the use of screws or by fixing lower ends of the frames 10 in position by way of grooves or projections provided on the support table or the like.

In the particular embodiment shown, two sets of work holder rods 11 are provided on the front and rear sides of the carrier to support a large number of work pieces 4 in two rows on the front and rear sides of the work carrier assembly 1. If desired, only one set or more than two sets of work holder rods 11 may be provided on the first work carrier 2.

Figure 5:
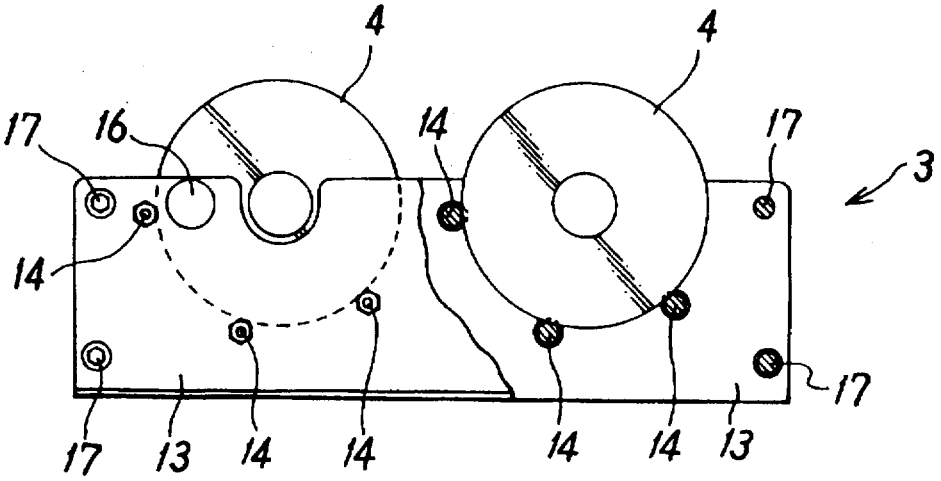
FIG. 5 is a sectioned side view of a work transferring carrier member.
Figure 6:
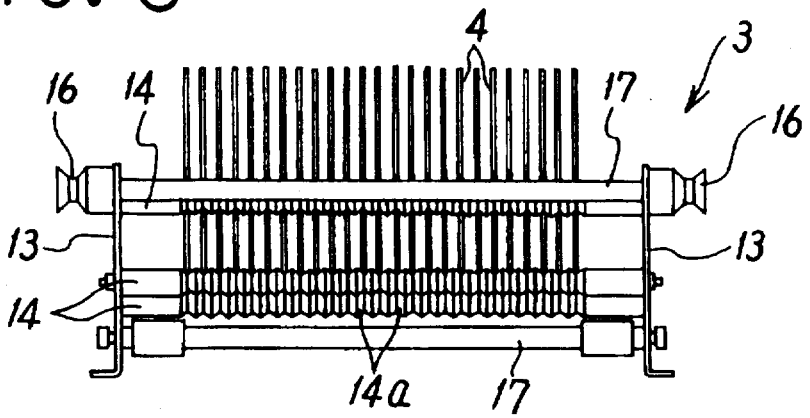
FIG. 6 is a schematic front view of the transferring carrier member of FIG. 5.

On the other hand, the second work carrier member 3, which serves as loading and unloading means for untreated and treated work pieces, is arranged as shown in FIGS. 5 and 6. More specifically, the second carrier member 3 includes a pair of opposingly confronting frames 13 which are spaced from each other by such a distance as will fit in the first carrier member 2. Fixedly mounted on these frames 13 are a plural number of transverse work holder rods 14 (three work holder rods in the case of the particular embodiment shown) in vertically staggered positions forming a pocket in concentric relation with counter peripheries of work pieces 4 to be supported thereon. These work holder rods 14 are each provided with a plural number of circumferential grooves 14*a* at predetermined uniform intervals in the axial direction thereof to support work pieces 4 in upright and uniformly spaced positions by engagement with outer peripheries of the work pieces 4 at different angular positions. The circumferential grooves 14*a* on the work holder rods 14 of the second work carrier member 3 are formed in the same positions and at the same intervals as the circumferential grooves 11*a* on the work holder rods 11 of the first work carrier member 2.

The second work carrier member 3 is provided with two sets of work holder rods 14 in its front and rear side portions in exact correspondence in number to the work holder rods 11 on the first work carrier member 2.

In order to preclude interferences between the work holder rods of the two work carrier members when engaged with each other in an overlapped state, the work holder rods 14 of the second carrier member 3 are located in forwardly or rearwardly shifted positions around the outer peripheries of work pieces 4 and in slightly lower positions relative to the work holder rods 11 on the first carrier member 2 so that the work holder rods 14 can take lower support positions between the work holder rods 11 when in the overlapped state.

Accordingly, when the second carrier member 3, which is loaded with a large number of flat plate-like work pieces 4, is placed in the first carrier member 2 from above, the work holder rods 14 of the second carrier 3 are received in the spaces between the work holder rods 11 of the first carrier member 2 to assume lower positions than the latter. Therefore, in the course of lowering the second carrier member 3 into engagement with the first carrier member 2, the work pieces 4 on the work holder rods 14 of the second carrier member 3 are automatically handed over onto the work holder rods 11 of the first carrier 2. At this time, the work holder rods 14 of the second work carrier member 3 take different work support positions from the work holder rods 11 of the first carrier member 2.

Conversely, when the second carrier member 3 is lifted and separated from the first carrier member 2, the work pieces 4 on the work holder rods 11 of the first carrier member 2 are automatically picked up on the work holder rods 14 of the second carrier member 3 and ejected from the treating apparatus along with the second carrier member 3.

The side frames 10 of the first carrier member 2 are provided with notches 10*a* of a suitable shape for evading the work holder rods 14 of the second carrier member 3 when the two carrier members are engaged with each other in an overlapped state. On the other hand, hooks 16 are provided on the side frames 13 of the second carrier member 3 for use in lifting same up and down by loading and unloading means.

In the drawings, indicated at 17 is a shaft which is bridged between the side frames 13 of the second carrier member 3, and at 18 are spacers which are provided on the outer sides of the side frames 10 of the first carrier member 2 to delimit the depth of fitting engagement of the first and second carrier members 2 and 3.

Figure 7:
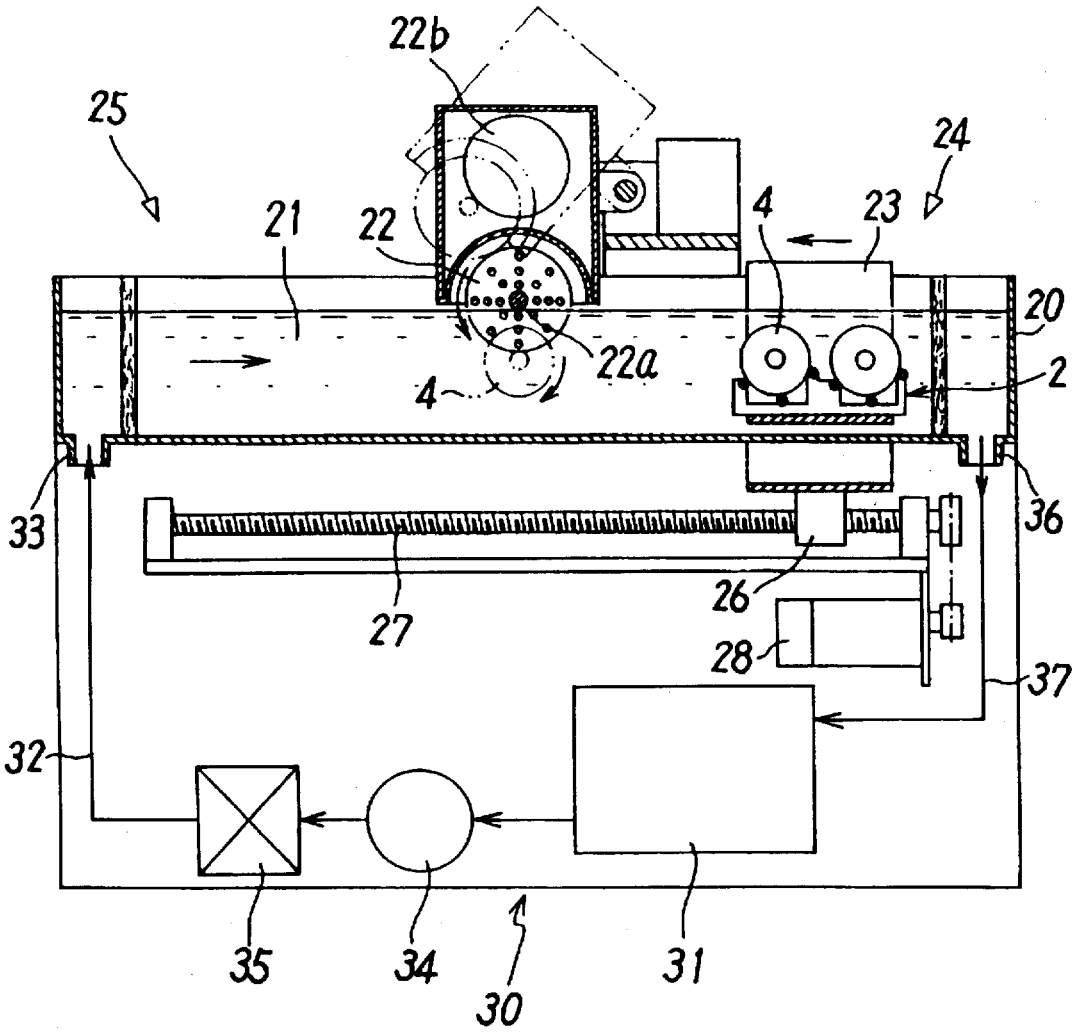
FIG. 7 is a sectioned side view of a scrubbing apparatus incorporating the work carrier assembly according to the invention.

Shown by way of example in FIG. 7 is a scrubber which employs the above-described work carrier assembly 1 according to the invention. The scrubber has a washing vessel 20 which maintains a continuous flow of a wash liquid 21 such as water, detergent or chemical solution from one end to the other, and in which a large number of work pieces 4 supported on the first carrier member 2 of the work carrier assembly 1 are scrubbed in a submerged state under the wash liquid 21 by means of a plural number of rotating brushes 22. On a transverse brush shaft 22*a* which is driven from a motor 22*b*, the rotating brushes 22 are mounted in a row with spacings similar to the work pieces 4.

The first carrier member 2 is mounted on top of a transfer table 23 for travel back and forth in and along the wash vessel 20 between a loading station 24 at a downstream end of the wash vessel 20 and an unloading station 25 at an upstream end. The transfer table 23 is coupled with a screw rod 27 through a nut 26, and moved back and forth between the loading and unloading stations 24 and 25 as the screw rod 27 is turned in the forward and reverse directions by a motor 28.

Indicated at 30 in the drawing is a liquid feed mechanism which supplies the wash liquid 21 to the wash vessel 20, and which includes a liquid feeder tank 31 with wash liquid cleaning functions, a pump 34 for sending the wash liquid from the tank 31 to a liquid inlet 33 through a feed pipe 32, and a filter 35 for filtration of the feed liquid. Spent wash liquid flowing out through a liquid outlet 36 is collected in the tank 31 and cleaned for recirculation to the wash vessel 20.

In the scrubber of the above-described arrangements, the second carrier member 3, which is loaded with unwashed work pieces 4, is lowered and placed in the first carrier member 18 from above at the loading operation 31 by operating a work loader, which is not shown. At this time, as described hereinbefore, the work pieces 4 on the second carrier member 3 are automatically transferred onto the work holder rods 11 of the first carrier member 2 and thereby supported in predetermined spaced positions.

In this state, the first and second carrier members 2 and 3, which are supported on the table 23, are transferred toward the upstream end of the vessel at a predetermined speed and under the surface of the wash liquid 21. The transfer table 23 is stopped as soon as work pieces 4 in a front row on the first carrier member 2 reach a predetermined scrubbing position to scrub the work pieces 4 of the front row with the rotating brushes 22. At this time, by frictional contact with the rotating brushes 22, the individual work pieces 4 are caused to rotate in such a way as to follow the rotation of the brushes 22.

Upon finishing the scrubbing operation on the front row, the two carrier members 2 and 3 are moved forward by the table 23 by a predetermined distance, followed by a similar scrubbing operation on the work pieces 4 in the rear row.

Upon completing the scrubbing cycles for all of the work pieces 4, the carrier members 2 and 3 are further advanced by the table 23 as far as the unloading station 25, where the second carrier member 3 alone is lifted up out of the flow vessel 20 and separated from the first carrier member 2 by an unloader which is not shown. At this time, the washed work pieces 4 on the first carrier member 2 are automatically picked up on the work holder rods 14 of the second carrier member 3 and thereby ejected upward of the flow vessel 20.

The ejected second carrier member 3 is then fitted in another second carrier member 2 together with the washed work pieces 4 for transfer to a next stage of treatment.

After ejection of the second carrier member 3 and the scrubbed work pieces 4, the first carrier member 2 is returned to the loading station 24 by the transfer table 23 19 to receive another second carrier member 3, which is loaded with unwashed work pieces, and moved forward again to repeat the above-described scrubbing operations.

Thus, the above-described work carrier assembly 1, which is composed of two types of carrier members 2 and 3, can use the first carrier member 2 as a support for work pieces during a treatment while using the second carrier member 3 for loading and unloading work pieces to and from the first carrier member 2. Accordingly, the first carrier member 2 of the work carrier assembly can be arranged in a construction which can support work pieces in a manner suitable for a particular treatment, and the second carrier member 3 can be arranged in a construction which is suitable for work loading and unloading operations. Thus, the work carrier assembly of the invention it possible to transfer a plural number of work pieces collectively by the second carrier or carriers while supporting work pieces under treatment in a suitable manner by means of the first carrier.

In the foregoing embodiments, the second carrier member 3 is provided with fixed work holder rods 14, while the first carrier member 2 is provided with rotatable work holder rods 11. However, if necessary, the work carrier assembly may have a second carrier member 3 with fixed work holder rods in combination with a first carrier member 2 with fixed work holder rods 11. Alternatively, fixed or rotatable work holder rods may be provided on both of the first and second carrier members if desired.

Although the work carrier assembly 1 of the foregoing embodiment is arranged for work pieces 4 of circular disc-like shape, it can be easily adapted to work pieces of square or rectangular shapes by slight alterations in the positions of the work holder rods 11 and 14.

Desirably, the above-described first and second carrier members are both formed of a heat- and chemical resistant material.

Thus, according to the present invention, different roles are played by the two carrier members of the work carrier assembly, namely, by the first carrier member which serves for supporting work pieces during a treatment and the second carrier member which serves for loading and unloading work pieces to and from the first carrier member. The first and second carrier members are therefore arranged differently in construction for playing the respective roles in an efficient way, for loading and unloading a plural number of work pieces collectively and for supporting individual work pieces in a suitable manner while receiving a treatment.

What is claimed is:

1. A work carrier assembly, comprising:

first and second work carrier members separably engaged with each other and each provided with a plural number of parallel work holder rods for supporting flat plate-like work pieces;

work holder rods of said two carrier members being located in vertically staggered positions and shifted relative to each other in a forward or rearward direction in terms of travel direction of said carriers and also in a the vertical direction in such a way that said work pieces are supported on said work holder rods of one of said carrier members when said two carrier members are engaged with each other and picked on said work holder rods of the other carrier member when said two carriers are disengaged from each other.

2. A work carrier assembly, comprising:

a first carrier member mounted on a work treating apparatus for supporting a plural number of disc-like work pieces while undergoing a treatment on said apparatus;

a second carrier member vertically movable into and out of engagement with said first carrier member for loading and unloading a plural number of work pieces to and from said first carrier member;

each one of said first and second carrier members being provided with a plural number of parallel work holder rods each having a plural number of circumferential grooves at intervals along the length thereof for engagement with peripheral edge portions of said work pieces for holding same in predetermined spaced upright positions;

work holder rods of said two carrier members being located in vertically staggered positions and shifted relative to each other in a forward or rearward direction in terms of travel direction of said carriers and also in a the vertical direction in such a way that said work holder rods of said second carrier member take lower work support positions than said work holder rods of said first carrier member and that said work pieces are transferred onto said work holder rods of said first carrier member when said two carrier members are engaged with each other and picked on said work holder rods of said second carrier member when said two carriers are separated from each other.

3. A work carrier assembly as defined in claim 1 or 2, wherein said two carrier members are located in vertically staggered positions to form a pocket concentric with disc-like work pieces to be supported thereon.

4. A work carrier assembly as defined in claim 3, wherein said work holder rods on said first carrier member are rotatably mounted thereon while said work holder rods on said second carrier member are fixedly mounted thereon.

5. A work carrier assembly as defined in claim 2, wherein said second carrier member is provided with hooks for lifting same toward and away from said first carrier member.

* * * * *